US005941159A

United States Patent [19]

Hansell et al.

[11] Patent Number: 5,941,159

[45] Date of Patent: Aug. 24, 1999

[54] INTEGRAL HOLDOWN PIN MECHANISM FOR HYDRAULIC POWER UNITS

[75] Inventors: Jeffrey C. Hansell, Ames; Charles M. Pohar, Roland, both of Iowa

[73] Assignee: Sauer Inc., Ames, Iowa

[21] Appl. No.: 09/005,253

[22] Filed: Jan. 9, 1998

[51] Int. Cl.[6] ..... F01B 13/04

[52] U.S. Cl. ..... 92/71; 91/499

[58] Field of Search ..... 92/12.2, 57, 71; 91/499, 505

[56] References Cited

U.S. PATENT DOCUMENTS

| | | | |
|---|---|---|---|
| 241,046 | 5/1881 | Wahlmark | 91/499 X |
| 1,794,575 | 3/1931 | Borletti | 91/12.2 X |
| 2,776,628 | 1/1957 | Keel . | |
| 2,776,629 | 1/1957 | Keel . | |
| 3,405,646 | 10/1968 | Thoma | 91/499 |
| 3,457,873 | 7/1969 | Fischer | 91/499 X |
| 3,468,263 | 9/1969 | Niemiec | 91/499 |
| 3,481,277 | 12/1969 | Pettibone . | |
| 3,643,549 | 2/1972 | Nagatomo | 91/505 |
| 4,884,952 | 12/1989 | Kanamaru et al. | 92/12.2 X |
| 5,230,274 | 7/1993 | Yu et al. | 91/499 |
| 5,279,205 | 1/1994 | Carlson, Jr. et al. | 91/499 X |
| 5,752,428 | 5/1998 | Jepsen | 91/499 |
| 5,778,757 | 7/1998 | Kristensen et al. | 92/12.2 |
| 5,784,949 | 7/1998 | Ryken et al. | 92/71 X |
| 5,813,315 | 9/1998 | Kristensen et al. | 92/71 |

*Primary Examiner*—John E. Ryznic
*Attorney, Agent, or Firm*—Zarley, McKee, Thomte, Voorhees & Sease

[57] ABSTRACT

A holddown pin mechanism for hydraulic power units has a cylindrical flat base washer having a central opening and opposite sides, a plurality of spaced elongated holddown pins have one end rigidly secured to one side of said base washer and an outer end. The pins extend outwardly at right angles from the side of said washer to which they are secured. The holddown pin mechanism is placed in a hydraulic cylinder block having a center bore, with the pins extending into holes in the block. A guide member on a shaft extending through the block engages the free ends of the pins.

13 Claims, 4 Drawing Sheets

INTEGRAL HOLDOWN PIN MECHANISM FOR HYDRAULIC POWER UNITS

BACKGROUND OF THE INVENTION

The present invention relates to hydraulic power transmission devices, more particularly pumps and motors of the axial piston type. The invention relates to an improved means for retaining pins which hold down the slippers attached respectively to each of the reciprocating pistons.

In conventional axial piston hydraulic units whose inlet or charge pressure is relatively low, a slipper holddown mechanism is generally needed. One type of holddown mechanism utilized in open circuit pumps comprises a plurality of pins mounted in axially extending arcuate grooves spaced around the central bore of the cylinder block. The lower ends of the pins are engaged by a block spring which applies a holddown force that is transmitted to the slippers by the upper ends of the pins.

One shortcoming of the above mechanism is that each groove has a semi-circular cross-section which will only accommodate one-half the diameter of the pin. This allows the pins to be inserted laterally into the grooves, but a spring retainer comprising a C-shaped band of flat spring steel is needed to urge the pins radially outward so as to retain them in the slots.

Another shortcoming of this spring retained pin mechanism is that it is difficult to assemble. The pins can become dislodged from the slots before or after the spring retainer is added. The pins may fall into the cylinder block or rotating group assembly where they are difficult to retrieve. Generally, the tops of three pins are used to define a plane for supporting the slippers. If one of the dislodged or inadvertently omitted during servicing or assembly, the remaining pins may not be able to provide the desired planar support.

Some prior structures restrict the radial inwardly movement of holddown pins by restricting the lateral dimensions of grooves in the slots holding the pins. The restricted dimensions of the grooves prevent the pins from moving radially inwardly out of the slots. However, the otherwise loose pins could freely rotate against surfaces adjacent the ends thereof. Hardened washers are needed to counteract this movement of the pins. This adds to the cost of production and assembly.

Another conventional slipper holddown mechanism utilizes a footed pin. The generally L-shaped footed pin has an elongated vertical portion and a truncated horizontal portion which extends outwardly therefrom at an angle of approximately 90°. The horizontal portion of the footed pin engages the top of the block spring and extends radially outward beyond the inner diameter of the cylinder block. The vertical portion of the pin extends upwardly along a slot or groove provided in the inner diameter of the cylinder block. A plurality of pins and slots are spaced around the inner diameter of the cylinder block. The footed pin protrudes upwardly from the top of the cylinder block to support the slippers. However, each slot has an open side through which the footed pin can be inserted. The footed pins are easier to install than the spring retained pins because the spring retainer has been eliminated. However, the footed pins are much more costly to manufacture than straight pins.

All of the foregoing devices comprise a plurality of parts, including the separate pins.

Therefore, a primary object of the present invention is the provision of an improved means for retaining slipper holddown pins.

A further object of this invention is to provide a slipper holddown mechanism which is comprised of a single part, and which will not permit the movement of the pins to wear against an abutting end surface.

A further object of the present invention is the provision of a slipper holddown mechanism which prevents lateral or radial displacement of the pins once installed.

A further object of the present invention is the provision of a slipper holddown mechanism which is easy to assemble.

A further object of the present invention is the provision of a slipper holddown system which is economical to produce, durable in use and simple in construction.

These and other objects will be apparent from the drawings, the description and the claims which follow.

SUMMARY OF THE INVENTION

The present invention relates to an improved apparatus for retaining slipper holddown pins, and thereby retaining slippers in an axial piston hydraulic unit. The hydraulic unit includes a cylinder block with a bore having a diameter which is drivingly engaged by a shaft. The cylinder block has a plurality of holes therein for respectively receiving a corresponding plurality of elongated slipper holddown pins which are in communication with the bore. The pins are secured to or integral with a cylindrical base washer to hold the pins against any independent motion, such as rotation about their own axes, or radial movement out of the slots in which they are positioned.

Before or after inserting the shaft, one end of the pins is inserted into the holes in the cylinder block, with their opposite ends being in fixed relation to each other by being affixed to the base washer. Thus, the pins are radially constrained in the holes without applying external forces. The flexibility of the assembly process is enhanced. Not only does this apparatus make assembly of the rotating group much easier, a more reliable product results. The pins will not be dislodged and lost in the assembly process.

These and other objects will be apparent to those skilled in the art.

DETAILED DESCRIPTION OF THE PREFERRED EMBODIMENT

Figure 1:
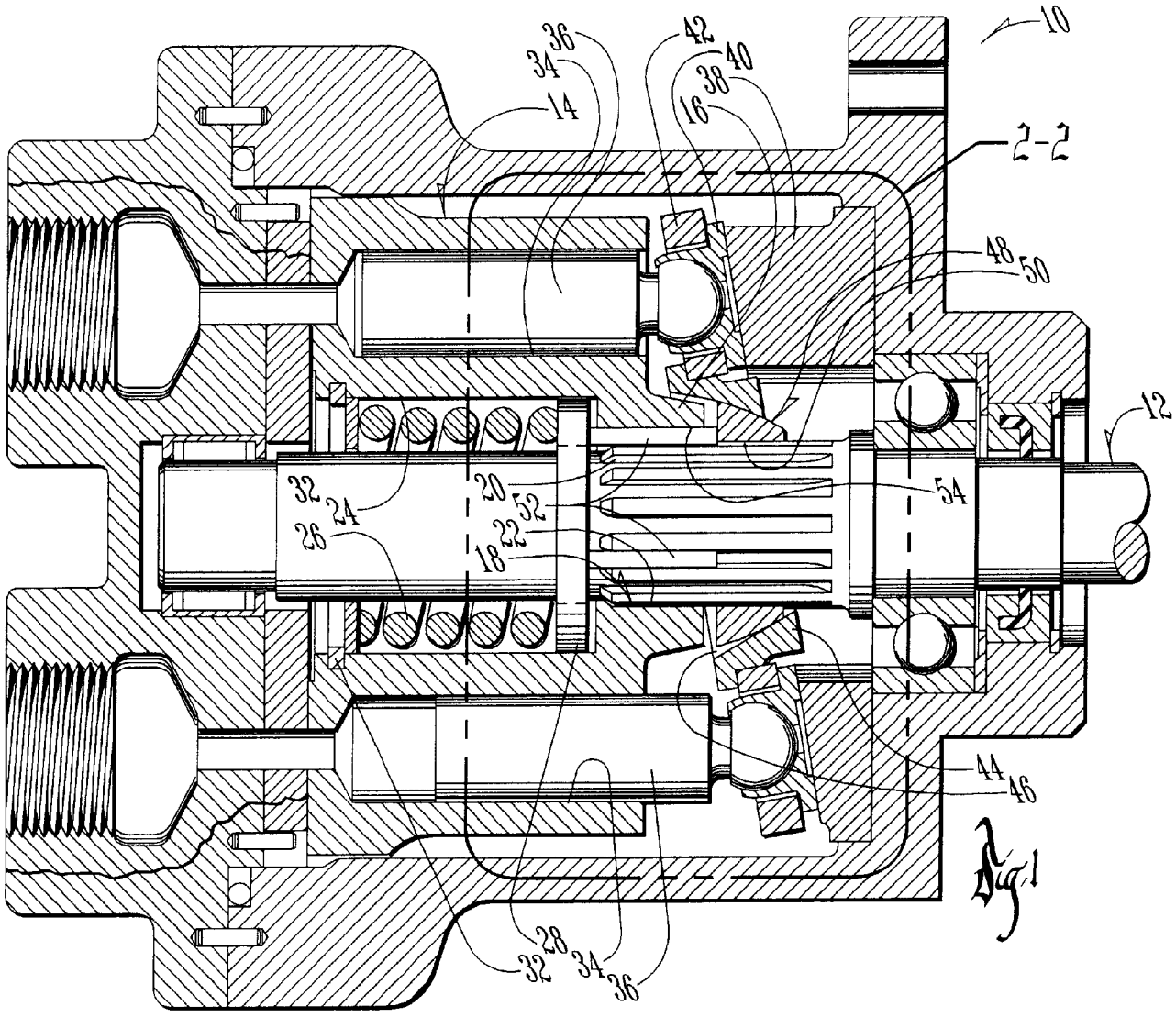
FIG. 1 is a cross-sectional view of a hydraulic unit having the slipper holddown mechanism of the present invention.

A hydraulic unit 10 is shown in FIG. 1. For purposes of illustration only, the hydraulic unit 10 is an axial piston open circuit pump. The invention can be adapted to other types of hydraulic units. The pump 10 includes an input shaft 12 which drivingly engages a cylinder block 14. The top of the cylinder block 14 includes a raised hub 16. A centrally located bore 18 (FIGS. 1, 2, 5) extends axially through the cylinder block 14 from top to bottom.

Figure 6:
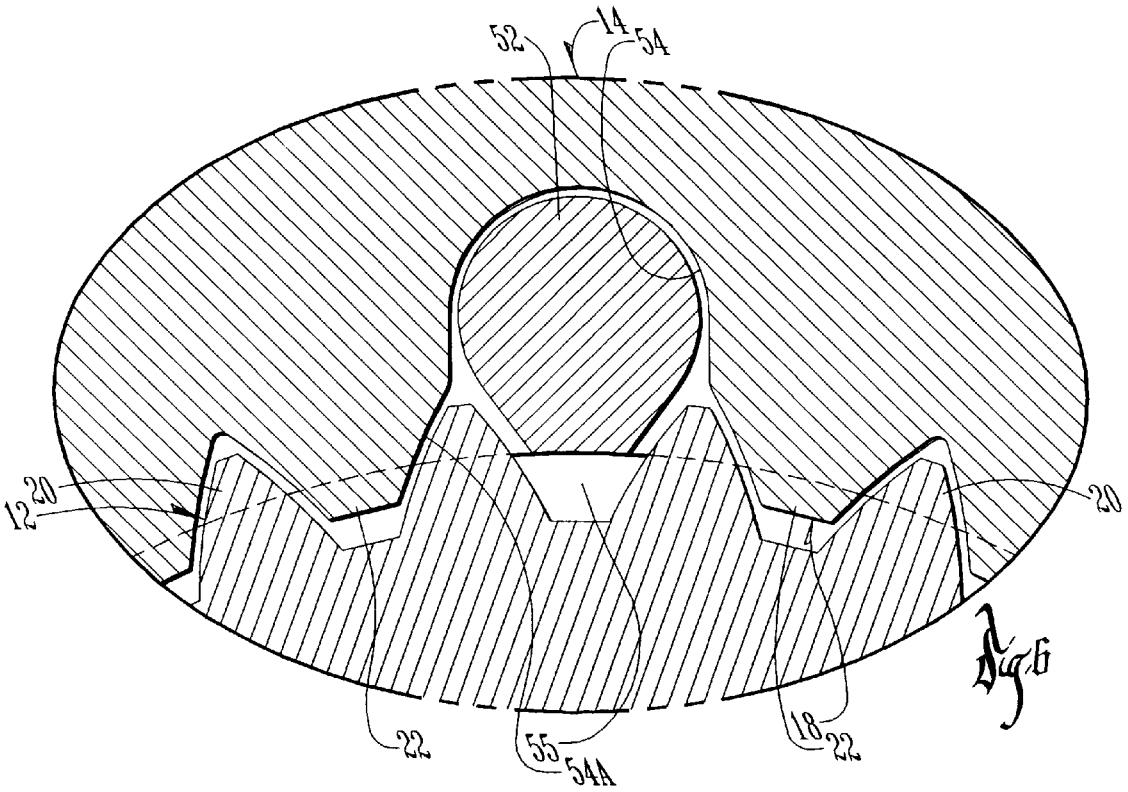
FIG. 6 is an enlarged scale sectional view taken on line 6—6 of FIG. 5.

A series of spaced apart involute splines 20 are provided on the shaft 12. The splines 20 matingly and drivingly engage a complementary series of spaced internal splines 22 formed on the diameter of the bore 18 of the cylinder block 14, as best seen in FIG. 6. However, other types of shaft/block engagement such as keys fitted to block spring 26 which abuts washers 28, 30 at either end and is held in place by a snap ring 32 conventionally mounted in the bore 24. The shaft 12 extends through the inner diameter of the spring 26.

Figure 2:
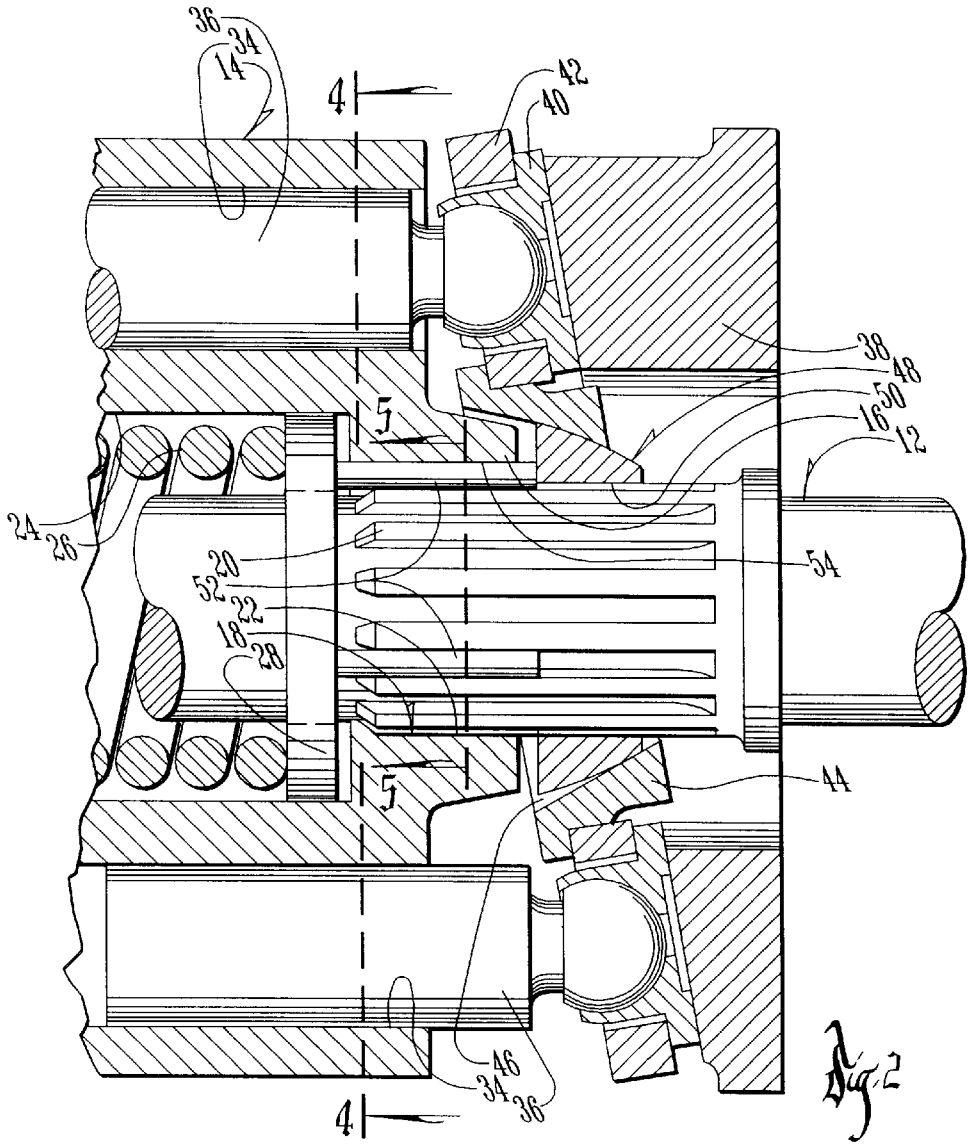
FIG. 2 is an enlarged cross-sectional view of the area designated by the line 2—2 in FIG. 1.

As best seen in FIGS. 1 and 2, the cylinder block 14 includes a plurality of bores 34 therein for slidably receiving a corresponding number of reciprocating pistons 36. When the cylinder block 14 is rotated by the shaft 12, the pistons 36 reciprocate within the bores 34, thereby drawing in fluid, pressurizing it, and then displacing the pressurized fluid. The particular action of the individual pistons upon the fluid at any particular point during the rotation of the cylinder block 14 is determined by a swashplate 38, as well-known in the art.

Each piston 36 has a slipper 40 attached thereto by conventional means such as swedging. A slipper retaining ring 42 engages the slipper 40 as shown in FIG. 2. The slipper retaining ring 42 is similarly engaged by a guide member 44. The guide member 44 has a centrally located conical opening 46 therein. The opening 46 pivotally engages the curved outer surface of a ball guide 48. The ball guide 48 has a central bore with a set of splines 50 which complement the splines 20 on the shaft 12. Thus, the ball guide 48 is rotated by the shaft 12. The guide member 44, the slipper retaining ring 42, and the slippers 40 are thus rotated substantially in unison with the cylinder block 14.

Figure 3:
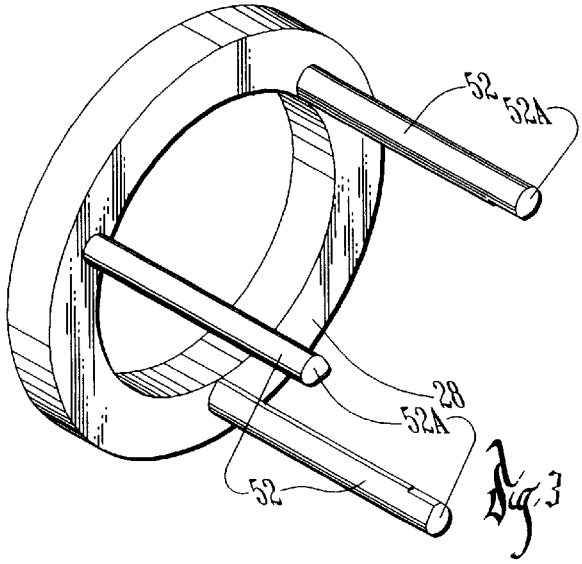
FIG. 3 is a perspective view of the holddown mechanism of this invention.

The ball guide 48 has a substantially flat planar lower surface which is supported by a plurality of slipper holddown pins 52. One end of the pins 52 are integral with or otherwise fixed to base washer 28 (FIG. 3). Preferably, three slipper holddown pins 52 are utilized so as to establish a level horizontal plane of support fox the ball guide 48, as best seen in FIG. 2.

Figure 4:
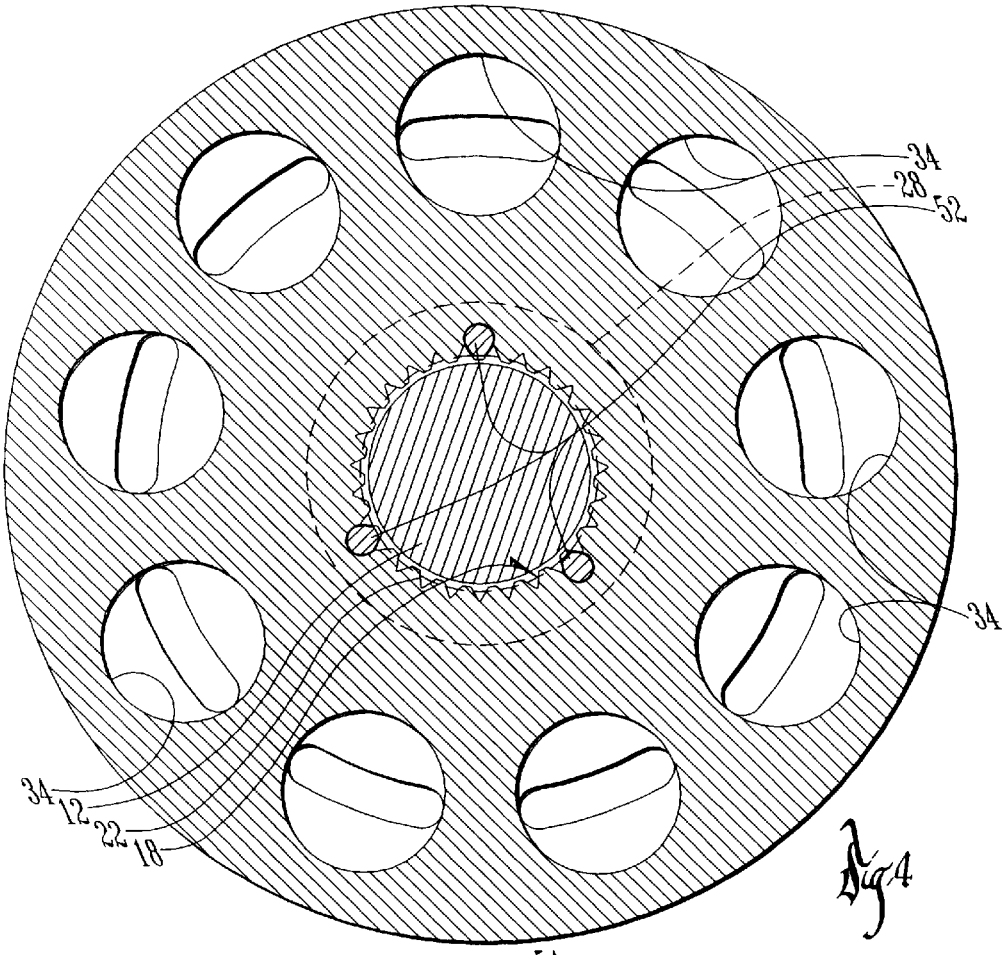
FIG. 4 is an enlarged scale sectional view taken on line 4—4 of FIG. 2.
Figure 5:
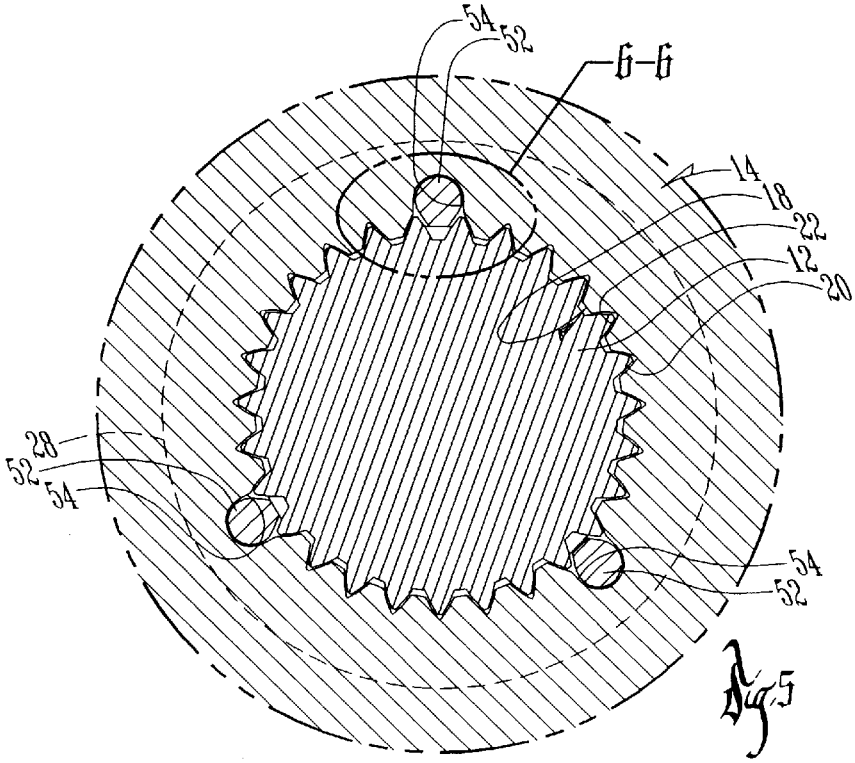
FIG. 5 is a sectional view taken on line 5—5 of FIG. 2.

The novelty of the present invention lies primarily in the way the pins 52 are retained relative to the cylinder block 14 by means of their attachment to washer 28. As best shown in FIGS. 4–6, the cylinder block 14 includes a plurality of holes 54 adjacent to and in communication with an elongated groove 54A in the bore 18. When the device is assembled as shown in FIGS. 4–6, the holes 54 are positioned adjacent a space 55 between the splines 22 on the bore 18 of the cylinder block 14.

Each of the pins 52 extends axially in one of the corresponding holes 54, but cannot be radially or laterally displaced therefrom once installed because of their rigid connection to washer 28. The lower end of the pins 52 engage the block spring 26 through the washer 28. The upper ends of the pins 52 protrude from the cylinder block at the hub 16 and engage the lower planar surface of the ball guide 48, as best seen in FIGS. 1 and 2. Through the spring 26, the washer 28, the pins 52 and the ball guide 48, a holddown force is applied to the slippers 40. Since pins 52 cannot rotate about their own axes, no protective washers need to be positioned between the free ends 52A of the pins and guide 48.

In FIG. 6, it is seen that the pin 52 has a maximum transverse diameter or width that allows it to be slip fit longitudinally into the hole 54.

Three holes 54 and pins 52 are preferably utilized. The upper ends of the three pins securely establish a plane of support for the ball guide 48 and thereby for the slippers 40.

In operation, the pins 52 can be simultaneously inserted into the holes 54 by grasping washer 28 either before or after the insertion of shaft 12 into bore 18. In neither event will the pins fall radially inwardly out of holes 54.

Thus, it can be seen that the present invention achieves at least all of its stated objectives.

What is claimed is:

1. A holddown pin mechanism for hydraulic power units, comprising, a cylindrical flat base washer having a central opening and opposite sides, a plurality of spaced elongated holddown pins having one end rigidly secured to one side of said base washer and an outer end, said pins extending outwardly at right angles from the side of said washer to which they are secured.

2. The mechanism of claim 1 wherein said pins and said base washers are of integral construction.

3. The mechanism of claim 1 wherein said pins are of equal length.

4. The mechanism of claim 1 wherein said pins are equally spaced with respect to each other.

5. The mechanism of claim 1 wherein said pins are three in number.

6. A hydraulic unit having a cylinder block including a center bore drivingly engaged by a shaft, a plurality of elongated holes in said cylinder block extending in a direction parallel to said center bore, the improvement comprising, an elongated slipper holddown pin in each of said holes, and having opposite ends, and a base washer having opposite sides with one end of each pin being rigidly affixed to one side of said base washer.

7. A hydraulic unit having a cylinder block including a center bore drivingly engaged by a shaft, a plurality of elongated holes in said cylinder block extending in a direction parallel to said center bore, the improvement comprising, an elongated slipper holddown pin in each of said holes, and having opposite ends, a base washer having opposite sides with one end of each pin being rigidly affixed to one side of said base washer, and a guide member on said shaft engaging the ends of said pins opposite to said base washer.

8. The hydraulic unit of claim 7 wherein said cylinder block has a plurality of bores parallel to said shaft and each having a reciprocal piston thereon, with each piston being operatively connected to a swashplate in said hydraulic unit.

9. The hydraulic unit of claim 8 wherein a spring element in said center bore bears against said base washer to force the ends of said pins opposite to said washer into engagement with said guide member.

10. The hydraulic unit of claim 6 wherein said pins and said base washer are of integral construction.

11. The hydraulic unit of claim 6 wherein said pins are of equal length.

12. The mechanism of claim 6 wherein said pins are equally spaced with respect to each other.

13. The mechanism of claim 6 wherein said pins are three in number.

* * * * *